US008047927B2

(12) United States Patent
Henry

(10) Patent No.: US 8,047,927 B2
(45) **Date of Patent: *Nov. 1, 2011**

(54) LOW DEFLECTION CUE

(75) Inventor: Chris Henry, Varsenaere (BE)

(73) Assignee: Axus Investments S.A., Apia (WS)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,568

(22) Filed: Mar. 17, 2010

(65) Prior Publication Data

US 2010/0190562 A1 Jul. 29, 2010

Related U.S. Application Data

(63) Continuation of application No. 10/580,527, filed as application No. PCT/BE03/00205 on Nov. 28, 2003, now Pat. No. 7,708,646.

(51) Int. Cl.
*A63D 15/08* (2006.01)

(52) U.S. Cl. ..... 473/44

(58) Field of Classification Search ..... 473/44–51
See application file for complete search history.

(56) References Cited

U.S. PATENT DOCUMENTS

| | | | | |
|---|---|---|---|---|
| 825,105 | A | 7/1906 | Borsdorf | |
| 1,664,971 | A | 4/1928 | Dean | |
| 3,103,359 | A | 9/1963 | Gentile, Jr. | |
| 3,381,959 | A | 5/1968 | Fiell | |
| 3,476,388 | A | 11/1969 | Heckett | |
| 4,816,203 | A | 3/1989 | Son-Kung | |
| 5,112,046 | A | 5/1992 | Thorpe | |
| 5,725,437 | A | 3/1998 | McCarty et al. | |
| 6,110,051 | A | 8/2000 | McCarty et al. | |
| 6,111,051 | A | 8/2000 | Chiang et al. | |
| 6,162,128 | A | 12/2000 | McCarty et al. | |
| 6,267,686 | B1 | 7/2001 | Legacie, Jr. | |
| 6,402,628 | B1 | 6/2002 | Neil | |
| 7,708,646 | B2 * | 5/2010 | Henry | 473/44 |
| 2003/0036434 | A1 | 2/2003 | Wu | |
| 2004/0018882 | A1 | 1/2004 | Church et al. | |
| 2007/0281794 | A1 | 12/2007 | Thurber et al. | |

FOREIGN PATENT DOCUMENTS

| | | |
|---|---|---|
| FR | 594.111 | 9/1925 |
| GB | 2 196 866 A | 5/1988 |
| WO | WO 82/03561 | 10/1982 |

* cited by examiner

*Primary Examiner* — Mark Graham
(74) *Attorney, Agent, or Firm* — Reinhart Boerner Van Deuren P.C.

(57) ABSTRACT

The present invention is related to a billiard cue comprising a shaft having a tip end and a butt end, wherein the shaft has a non-linear tapered section with reduced diameter compared to a linear tapering at the tip end. Also, a manufacturing process is disclosed which is simple and cheap. The cue of the present invention is low-cost and shows superior low deflection properties.

11 Claims, 3 Drawing Sheets

LOW DEFLECTION CUE

CROSS-REFERENCE TO RELATED PATENT APPLICATION

This patent application is a continuation of co-pending U.S. patent application Ser. No. 10/580,527, filed May 24, 2006, which was a National Stage of International Application No. PCT/BE2003/000205 filed Nov. 28, 2003, the entire teachings and disclosure of which are incorporated herein by reference thereto.

FIELD OF THE INVENTION

The present invention is related to billiard cues, pool cues, snooker cues and more specifically to cue shafts. More particularly, the present invention is related to a low deflection cue.

STATE OF THE ART

Billiard, pool or snooker cues are traditionally formed of an elongated shaft; a butt at one end of the shaft and a ferrule mounted on the other side. The side with the ferrule supports a tip. A cue can be made out of one or more pieces, which are joined together.

Traditionally, cues are made out of ash wood or maple. Other materials such as aluminium, steel, plastic and carbon fibre have also been used to form cue shafts. These cues have traditionally been engineered to approximate wood in weight, stiffness or rigidity. Other alternatives are shafts made out of wood with a thin composite outer skin formed of various fibres and/or resin combinations.

It is known to form a cue shaft of a solid glass bounded fibre as shown in U.S. Pat. No. 3,103,359. It is also known to form a cue shaft as a composite tube of carbon fibres in which the shaft has a wall thickness of 0.060 inches (0.1524 cm) or more and the hollow interior is filled with foam as shown in U.S. Pat. No. 4,816,203. U.S. Pat. No. 5,112,046 discloses a shaft formed of a solid epoxy resin with a central graphite core. This shaft accommodates flexure and impact by utilizing elongated carbon filaments circumferentially spaced apart and concentrically disposed about the core and extending axially through the front and rear sections of the shaft.

It is also known to form a cue shaft having a hollow bore extending at least a predetermined distance from a first end towards a second end as shown in U.S. Pat. No. 6,111,051. In this shaft the bore forms an outer wall having a thickness of about 0.03 (0.076 cm) and 0.05 inches (0.127 cm). This shaft is preferably formed of a composite material consisting of fibres in a binder, such as carbon fibres in a epoxy resin.

U.S. Pat. No. 5,725,437 shows a cue shaft having a hollow bore and which is formed of a plurality of sections which generally have a pie or sector shape with an arcuate outer surface.

Other cues are formed out of laminated layers of wood. Usually, cues are tapered linearly from tip end to butt end. However, standard pool cues can also comprise a relatively large tip end (about 12-13 mm) with no or no significant tapering for about 15 inches, then a relatively high tapering section of about 4 inches, followed by a linear tapering up to the butt end. These cues' tip ends are too large in comparison with the balls played and will buckle when in use.

The tip, which is traditionally made out of leather, is adhesively joined to the ferrule. The tip is mostly produced with a large radius to create a relative flat contacting surface.

None of the prior art cues show acceptable low deflection. The more accurate cue models currently on the market are very expensive due to high production costs.

AIMS OF THE INVENTION

The present invention aims to provide a low-cost, highly accurate cue. Further, the present invention aims to provide a method for the manufacture of low-cost highly accurate cues.

SUMMARY OF THE INVENTION

The present invention concerns a billiard cue comprising a shaft having a tip end and a butt end, wherein the shaft has a non-linear tapered section with reduced diameter compared to a linear tapering at the tip end. The reduced diameter gives an increased flexibility to the tip end, which results in low deflection when a ball is struck off-centre. In the billiard cue of the present invention, said non-linear tapered section with reduced diameter extends preferably until about 14 inches from the tip end. This especially applies to standard 58-inch cues. Further, the shaft can have a non-linear tapered section with increased diameter from about 14 inches from the tip end to about 29 inches from the tip end. The billiard cue of the present invention thus preferably has a shaft, which shows an increased flexibility at the tip end compared to a linearly tapered shaft.

In another aspect of the present invention, a billiard cue is disclosed comprising a shaft having a tip end and a butt end, wherein the diameter of the shaft from the tip end is in a Boltzmann function relation to the distance from the tip end curve until at about half of the shaft.

In another aspect of the present invention, a manufacturing process is disclosed for making the cue shaft of the present invention. The technique used can be any technique suitable for treating the material used, such as sanding, laser, and manual or computer-directed turning lathe.

SHORT DESCRIPTION OF THE DRAWINGS

Figure 4:
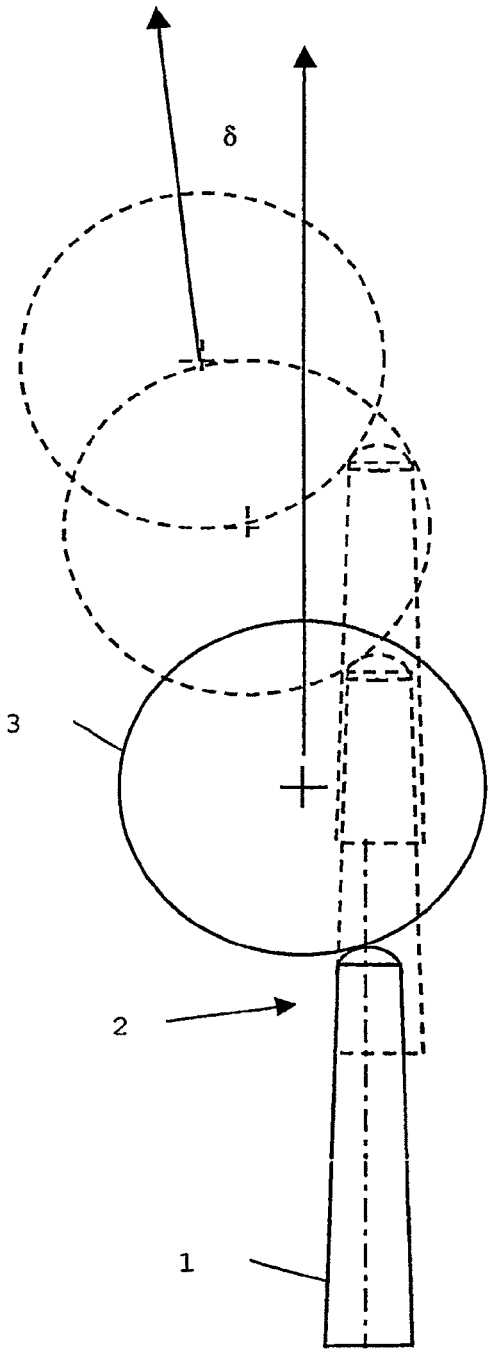
PRIOR ART Fig. 4

FIG. 4 draws the deflection of a cue ball, which is struck right from centre with a rigid cue according to the prior art.

Figure 5:
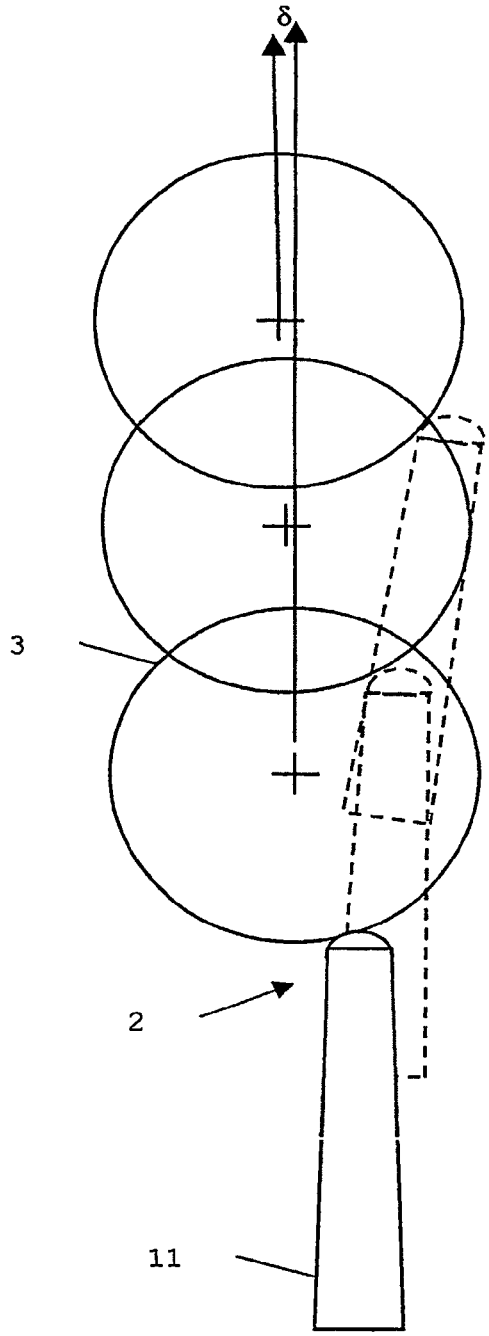

FIG. 5 represents the deflection of a cue ball, which is struck right from centre with a cue with flexible distal end according to the present invention, showing significant reduction in deflection as compared to the prior art rigid cues.

Figure 6:
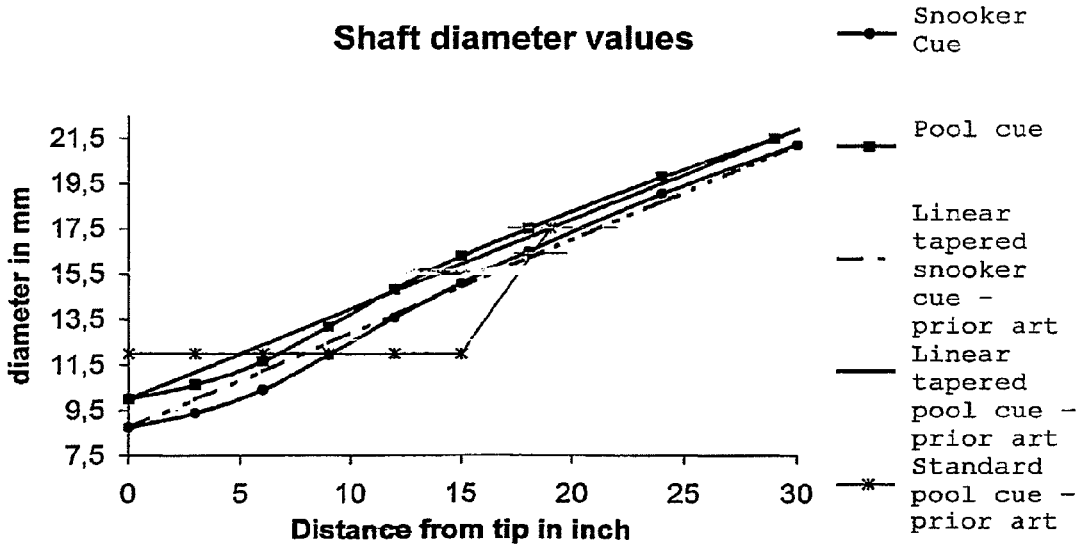

FIG. 6 shows a graph of the diameter tapering for respectively a snooker cue and a pool cue according to the present invention compared with a linear tapering as in the prior art.

DETAILED DESCRIPTION OF THE INVENTION

In use, the cue shaft is lined up with the intended direction of movement of the cue ball before striking the cue ball with the tip of the shaft. The cue can be lined up such that the direction of the cue is crossing a vertical line formed by the contact point of the cue ball with the surface (in a game situation that will be the cloth that covers the billiard/snooker or pool table) and its centre of gravity.

The cue can also be lined up to hit the cue ball off centre. This could be done consciously to impart side spin to the cue ball, in order to change its direction when it bounces of one or more cushions. Due to restrictions of players' technical capabilities to hit the cue ball perfectly in its centre and to follow through with the cue in a straight line, most strokes will result in undesired side spin on the cue ball.

As a result of the intended or unintended off centre contact and/or follow through the cue ball will not follow a direction that is parallel to the line of stroke of the cue. Due to the side force that is imparted on the cue ball, it will move in a path at an angle δ to the line of stroke of the cue. This angle δ is commonly called the angle of deflection and will hereafter be called deflection. The degree of deflection is related to different parameters. The speed of the shot, the nature of the cloth, how far off centre the cue ball is struck, the acceleration of the cue during the follow through, the length of the follow through, the characteristics of the cue will all have an influence on the angle δ of deflection.

Even though if one considers all parameters identical for two identical shots in the same conditions but played with different cues, then the degree of deflection will vary according to the characteristics of each individual cue. Tests performed by the applicant have shown that the cue characteristics have a big effect on the degree of deflection. It is also known and accepted amongst players that it is difficult to take account of the degree of deflection because it necessitates the player to line up the shot in another direction than the desired path of movement of the cue ball. The bigger the degree of deflection caused by a specific cue, the more the player will have to consciously correct this deflection by increasing the angle between the desired direction of the cue ball and the angle of aiming.

Due to the already mentioned technical restrictions of most players to hit the cue ball consistently in the centre while following through with the cue in a straight line, most strokes will inevitably impart, to a certain degree and in relation with the characteristics of the cue, unintended side spin to the cue ball, causing the cue ball to deflect from the intended direction. Thus, it would be desirable to develop a cue, which causes the cue ball to deflect under the smallest possible angle. Some of the above mentioned cue shafts are engineered to reduce the deflection of the cue ball when it is struck off centre but due to the nature of their concept, they are much more difficult to produce then a standard cue. Therefore it would be desirable to develop a cue which has a low deflection impact on the cue ball and which is easy to produce.

Figure 1:
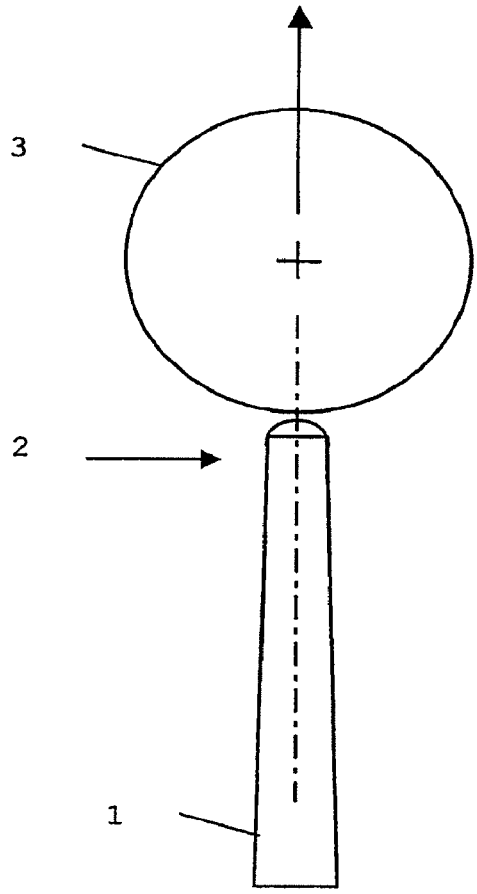
FIG. 1 represents a cue ball, which is struck centrally.
Figure 2:
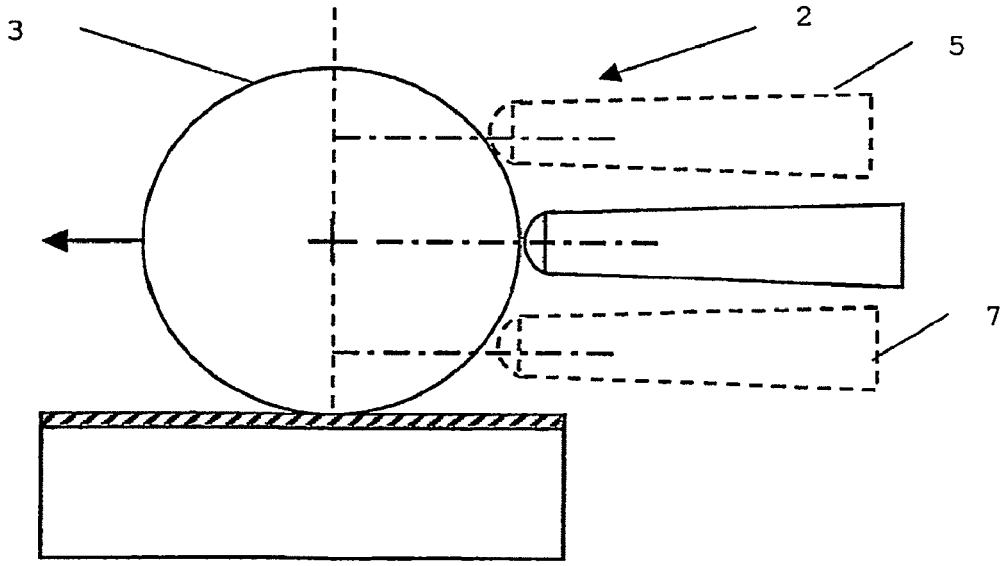
FIG. 2 represents a cue ball, which is struck on the central vertical line but with top and bottom spin.

As shown in FIG. 1 the cue ball 3 is struck central which is causing no deflection of the cue ball 3. As in FIG. 2 the cue ball 3 is being struck on the central vertical line but with top (5) and bottom spin (7).

Figure 3:
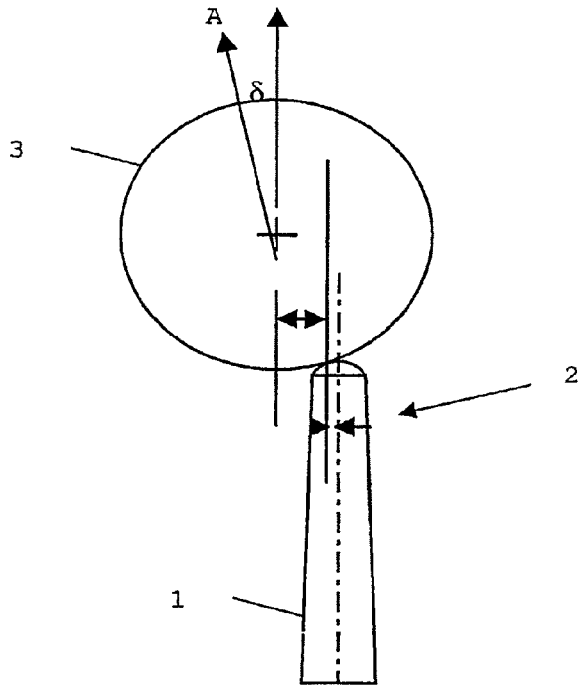
FIG. 3 shows a cue ball, which is struck right from centre.

It has been found that the flexibility of the cue shaft towards the tip end has a great impact on the angle ξ of deflection caused by the cue 1 on the cue ball 3. In FIG. 3, a cue ball 3 is struck with a rigid cue off centre to the right on a horizontal plane from the centre of the ball.

In the first sequence (FIG. 4) the cue tip strikes the cue ball right of centre which starts the deflection process to the opposite side. As the cue ball 3 is hit off centre, an angled force is exerted on the cue ball. This forces the deflection of the cue ball in the opposite direction to the side of impact. A rigid cue as demonstrated in FIG. 4, will bend only slightly which forces the cue ball to move aside of the intended direction of the cue ball.

In FIG. 5, the same shot is played with a cue 11 according to the present invention, with a more flexible shaft towards the tip end 2. At impact the cue strikes the cue ball on the same spot as FIG. 4. Because of the shafts flexibility, the cue 11 starts to bend in the direction of the side spin imparted, reducing the side force exerted on the cue ball 3 during its follow through. This bending of the shaft 11 allows the cue ball 3 to travel closer to the intended direction of the cue ball path reducing the degree of deflection δ.

EXAMPLE 1

Production Process

The most important aspect of the cue according to the present invention is its shaft and more in particular the first 29 inches (76.66 cm) of the cue. This part needs to be sanded according to specification with a maximum deviation of 0.1 mm. This can be done manually or e.g. via laser or a manual or computer-directed turning lathe.

The shafts of the cues are preferably made of ash or maple wood, but other wood can be used. Both preferred wood kinds are interchangeable and are of like quality.

The most important part of the shaft is the end near the tip. The flex of this part plays an important role in the reduction of throw and deflection. Due to the gradual, non-linear change of the diameter, a more flexible tip is obtained, which results in lower throw. For standard size cues, the first 29 inches (or about) is the most important part, while the rest of the cue can have traditional tapering.

DESCRIPTION OF A PREFERRED EMBODIMENT OF THE INVENTION

Cues are in general made for a specific game. Examples are given for snooker cues and pool cues. A cue is typically made for a specific ball, and its design is related to the ball's weight in particular. Smaller and lighter balls need slimmer cues with smaller ferrules, while heavier balls nee bigger ferrules. This is known in the art and the skilled person can easily apply the teachings of this document to design a cue for a specific ball.

A preferred embodiment of the present invention is a snooker cue, designed for snooker balls with a weight of about 143 g. The tapering of the complete cue, made in ash or maple wood, is given next:

| Distance from tip | Cue diameter |
|---|---|
| 0 | 8.75 mm |
| 3" | 9.38 mm |
| 6" | 10.41 mm |
| 9" | 11.94 mm |
| 12" | 13.59 mm |
| 15" | 15.11 mm |
| 18" | 16.51 mm |
| 24" | 19.05 mm |
| 30" | 21.21 mm |
| 36" | 23.11 mm |
| 42" | 25.02 mm |
| 48" | 26.42 mm |
| 54" | 27.94 mm |
| 58" | 29.21 mm |

Another preferred embodiment is a pool cue, equally made from ash or maple for balls of about 168 g, with following specifications:

| Distance from tip | Cue diameter |
|---|---|
| 0 | 10.00 mm |
| 3" | 10.63 mm |
| 6" | 11.66 mm |
| 9" | 13.19 mm |

-continued

| Distance from tip | Cue diameter |
|---|---|
| 12" | 14.84 mm |
| 15" | 16.29 mm |
| 18" | 17.51 mm |
| 24" | 19.79 mm |
| 29" | 21.50 mm |

FIG. 6 shows a graph depicting the relation between distance from the tip and the cue diameter. As a comparison, a linear cue reflecting the state of the art cues is given for each cue, in addition to a standard pool cue layout (approximate). One can clearly see that at the tip end, the diameter of the cues according to the present invention is significantly below the prior art type cues, giving the tip flexibility. Further, as from about 35 cm (about 14 inch) from the tip end, the diameter is higher than with the normal linear cue tapering. The diameter curves can be fitted with high correlation coefficient to a known Boltzmann curve (or a sigmoidal with variable slope) with the formula:

$$y = \text{bottom} + \frac{\text{top} + \text{bottom}}{1 + e^{\frac{x - x_0}{dx}}}$$

The invention claimed is:

1. A billiard cue comprising a shaft having a tip end and a butt end, wherein at the tip end the shaft has a non-linear tapered section with reduced diameter compared to a cue tapered linearly from tip end to butt end, wherein the non-linear tapered section comprises a continuously increasing diameter formed by a circular cross section extending over several inches within the first 14 inches from the tip end including a first portion proximate the tip end and a second portion behind the first portion and remote from the tip end, wherein in the first portion the diameter thereof increases at a slower rate per unit length than the rate of increase of the diameter in the second portion.

2. The billiard cue of claim 1, wherein the non-linear tapered section has a reduced diameter compared to a cue having a tip end and a butt end of same size and being tapered linearly from the tip end to the butt end.

3. The billiard cue of claim 1, wherein the non-linear tapered section with reduced diameter extends from the tip end.

4. The billiard cue of claim 1, wherein the non-linear tapered section with reduced diameter extends until about 14 inches from the tip end.

5. The billiard cue of claim 1 wherein the continuously increasing diameter extends substantially completely over the non-linear tapered section with reduced diameter.

6. The billiard cue of claim 1, wherein the continuously increasing diameter is continuously non-linearly increasing.

7. The billiard cue of claim 1, wherein in the first portion the diameter thereof increases at a slower rate per unit length than the rate of increase of the diameter of the cue tapered linearly and in the second portion the diameter thereof increases at a faster rate per unit length than the rate of increase of the diameter of the cue tapered linearly.

8. The billiard cue of claim 7, wherein in the first portion and in the second portion the diameter increases continuously non-linearly.

9. The billiard cue of claim 1, wherein the reduced diameter and the continuously increasing diameter are collectively sized and configured to provide an increased flexibility toward proximate the tip end and effects a lower deflection when the a ball is struck off-center as compared to said linearly tapered cue.

10. A billiard cue, comprising a shaft having a tip end and a butt end, wherein at the tip end the shaft has a non-linear tapered section with a reduced diameter compared to a cue tapered linearly from tip end to butt end, wherein the non-linear tapered section includes a first portion that when diameter is graphed versus distance from tip end, creates a graph with a generally concave curve, with a first region closer to the tip end that increases in diameter less rapidly than said traditionally tapered cue to thereby provide said reduced diameter; and a second region behind the first region that increases in diameter more rapidly than said linearly tapered cue.

11. The billiard cue of claim 10, wherein the reduced diameter and the non-linear tapered section are collectively sized and configured to provide an increased flexibility toward proximate the tip end and effect a lower deflection when a ball is struck off-center as compared to said linearly tapered cue.

* * * * *